US005474391A

United States Patent [19]

Andou et al.

[11] Patent Number: 5,474,391

[45] Date of Patent: Dec. 12, 1995

[54] PRINT GAP SETTING IN AN IMPACT PRINTER

[75] Inventors: Hirokazu Andou; Hideaki Ishimizu; Mitsuru Kishimoto; Yoichi Umezawa; Hiroshi Sakaino; Masahiko Shimosugi; Takanori Mimura, all of Tokyo, Japan

[73] Assignee: Oki Electric Industry Co., Ltd., Tokyo, Japan

[21] Appl. No.: 136,890

[22] Filed: Oct. 18, 1993

[30] Foreign Application Priority Data

Oct. 19, 1992 [JP] Japan ..... 4-280128
Dec. 11, 1992 [JP] Japan ..... 4-330814

[51] Int. Cl.[6] ..... B41J 25/304

[52] U.S. Cl. ..... 400/55; 400/59; 400/124.05

[58] Field of Search ..... 400/54, 55, 56, 400/57, 58, 59, 279, 712, 124.02, 124.04, 124.05, 124.06, 703, 708

[56] References Cited

U.S. PATENT DOCUMENTS

| | | | |
|---|---|---|---|
| 5,078,517 | 1/1992 | Hiroshi et al. | 400/59 |
| 5,088,842 | 2/1992 | Ito et al. | 400/59 |
| 5,137,377 | 8/1992 | Ito et al. | 400/56 |
| 5,205,658 | 4/1993 | Iriguchi | 400/55 |

FOREIGN PATENT DOCUMENTS

| | | | |
|---|---|---|---|
| 503871 | 9/1992 | European Pat. Off. | 400/56 |
| 57-103880 | 1/1982 | Japan | 400/54 |
| 57-157776 | 9/1982 | Japan | 400/56 |
| 62-121067 | 6/1987 | Japan | 400/54 |
| 63-047176 | 2/1988 | Japan | 400/56 |
| 63-306069 | 12/1988 | Japan | 400/56 |
| 2-249676 | 10/1990 | Japan | 400/56 |
| 2214338 | 8/1989 | United Kingdom | 400/54 |

*Primary Examiner*—David A. Wiecking
*Attorney, Agent, or Firm*—Steven M. Rabin; Allen Wood

[57] ABSTRACT

An impact printer having a print head, the print head having a movable armature, a printing wire fixed to the armature, and sensor for detecting movement of the armature. The position of the armature is monitored based on an output of the sensor. A home sensor detects whether the print head is at a home position. A paper end sensor detect whether a printing medium is between the platen and the print head. A gap motor means adjusts a gap between the printing wire and the platen. A gap controller is responsive to detection signals output by said home sensor and said paper end sensor, for controlling the print head to swing the armature so as to cause the tip of said printing wire to strike the platen, determining a time of impact of the tip with the platen based on the monitored position of the armature, performing a comparison of the time of impact with a predetermined impact time, and outputting a drive signal to the gap motor for adjusting the gap according to a result of the comparison.

20 Claims, 8 Drawing Sheets

PRINT GAP SETTING IN AN IMPACT PRINTER

CROSS-REFERENCE TO RELATED APPLICATION

This application claims priority benefits under 35 U.S.C §119 of Japanese applications Ser. No. 4-280, 128, filed Oct. 19th, 1992, and Ser. No. 4-330,814, filed Dec. 11th, 1992, the entire disclosures of which are incorporated herein by reference.

BACKGROUND OF THE INVENTION

1. Field of the Invention

This invention relates to an impact printer, and more particularly, to an impact printer provided with a plurality of electrostatic capacitance sensors within a wire dot print head (hereinafter simply "print head"), to monitor the operations of printing wires.

2. Description of Related Art

An impact printer has a print head mounted on a carriage. Within the print head are provided a plurality of electrostatic capacitance sensors for monitoring the operations of printing wires fixed to the tips of armatures that oppose cores of respective electromagnets. The printing wires are operative to print dots on a printing medium by driving coils of the respective electromagnets, the coils being wound around the respective cores. The output of an electrostatic capacitance sensor are used to control the length of time that a coil is driven, thereby to improve the quality of printing. Such impact printers also use the electrostatic capacitance sensors for detecting respective gaps between the printing medium and the printing wires. The detection of gaps serves, among other things, to distinguish the type of printing medium. For example, detection of the gap between the printing wires and the printing medium may be used to distinguish the printing medium as between single sheets of paper and four-sheet-duplication paper. Such detection of gaps and determinations of printing medium are used to adjust the gaps to optimum values for improved printing quality.

During printing, a gap between an ink ribbon and each of the printing wires will vary depending on the type of printing medium, for example, whether the printing medium is a single sheet of paper or is four-sheet-duplication paper. Thus, the gap is wider when the printing medium is a single sheet of paper than when the printing medium is four-sheet-duplication paper. As a result, the printing wires will operate differently in each case. That is, the time duration of a stroke of a printing wire (hereinafter "impact time"), upon which the printing wire strikes the printing medium, is longer when the printing medium is a single sheet of paper than when the printing medium is four-sheet-duplication paper. Using the relationship of impact time to paper type, the impact printer can distinguish the type of printing medium, as well as detect the thickness of the printing medium. The printer adjusts the gap to have an optimum value that optimizes the control of the armatures of the printer for the particular type of printing medium. This optimum value is established in relation to a standard gap between each printing wire and the platen of the printer at the time that the printer is assembled.

The information which indicates the standard gap (hereinafter called "standard information value") is measured under predetermined conditions and stored in a non-volatile memory of the printer, so that the standard information value can be preserved as an initially stored value even if a power source for the printer is cut off. The standard information value of conventional impact printers cannot be adjusted or renewed during repeated use of the printer when once set to an optimum value.

In such a known impact printer, however, it is difficult to maintain the optimum gap after repeated use of the printer. In such a printer, alternating deactivations and activations of a coil cause the strokes of the printing wire toward and away from the platen. Upon each stroke the attracting end of the core contacts, and therefore slowly abrades, a side of the armature. Abrasion of the armature results in a lengthening of the stroke of the printing wire. Also, the gap between the printing wire and the platen is lengthened. Therefore, even though the gap initially is set to an optimum value, at a time that the impact printer is built and adjusted, repeated printing cause the gap to be increased and therefore to become greater than the optimum value.

Moreover, the optimum gap may be changed by wear of the tip of the printing wire and of the carriage, and by external impacts exerted upon the printer. Also, by such wear and impacts, the impact time of each printing wire, as detected on the basis of the output of the corresponding electrostatic capacitance sensor, changes, thereby reducing the accuracy with which gaps are detected and with which the types of printing medium are distinguished.

SUMMARY OF THE INVENTION

It is an object of the invention to provide an impact printer which solves the above-described problems in a conventional impact printer. It is a further object of the invention to provide an impact printer capable of accurate gap detection, an accurate determination of the type of printing medium, even after the parts of the printer have become worn from repeated use, and improved printing quality.

It is another object of the invention to provide an impact printer capable of accurate standard information value detection, and accurate renewal of the value, even after the parts of the printer have become worn from repeated use.

The foregoing objects are accomplished with an impact printer having a print head, the print head having an armature, a printing wire fixed to the armature, an electrostatic capacitance sensor being formed from the armature and a part fixed in opposition to the armature, the armature being movable with respect to the fixed part. The impact printer according to the invention includes a monitoring means for monitoring the position of the armature, based on an output of the sensor, while the armature is moved relative to the fixed part. The printer further includes a home sensor means for detecting whether the print head is at a home position at one end of the platen, and a paper end sensor for detecting the existence of a printing medium between the platen and the print head. A gap motor is provided for adjusting a gap between the printing wire and the platen. In addition, a gap control means, responsive to detection signals output by the home sensor and the paper end sensor, performs the following functions at a time of resetting the gap:

(a) control of the print head to swing the armature so that the tip of the printing wire strikes the platen, (b) determination of a time of impact of the tip with the platen, based on the monitored position of the armature, (c) comparison of the time of impact with a predetermined impact time, and (d) output of a drive signal to the gap motor for adjusting the gap according to a result of the comparison.

During the resetting period, since the gap is adjusted to a proper length, the impact printer can accurately detect the thickness and type of the printing medium, even if the gap has changed from wear caused by repeated use.

According to a preferred embodiment of the invention, a counter is provided for counting the number of stokes of the printing wires and outputting an interrupt signal for adjusting the gap each time a predetermined number of printing strokes has been counted. The gap can be adjusted outside of an area for printing, notwithstanding the position of the print head, and accordingly, the ink from the ink ribbon never contacts the platen. The gap also can be adjusted while the platen is rotated, which permits the gap control means to use information about the eccentricity of the platen to improve the accuracy of adjustment of the gap.

In another embodiment, the impact printer further includes an alarm display means, a mode selecting means, and a memory means for storing data indicative of an impact time corresponding to a predetermined gap. The mode selecting means serves for selecting either an automatic mode or a non-automatic mode, as a mode, for adjusting the gap. The mode selecting means outputs a signal indicative of the selected mode. If the automatic mode has been selected, the gap control means automatically controls an adjustment of the gap. When the non-automatic mode is selected, the gap control means activates the alarm display means when the gap is detected to equal or exceed a predetermined value.

According to another aspect of the invention, an impact printer has a monitoring means for monitoring the position of the armature, based on an output of the electrostatic capacitance sensor while the armature is moved relative to a fixed part, the monitoring means including speed waveform determining means for determining a speed waveform of the armature while the printing wire is moved under predetermined conditions. A detecting means is provided for detecting an operation time of the printing wire, during which time the printing wire is moved with respect to the fixed part, the detecting means detecting the operation time based on the determined speed waveform. A memory stores the detected operation time as one or more standard information values. A renewing means is provided for renewing the standard information values stored in the memory. An adjusting means adjusts a gap between the printing wire and the platen, according to the standard information values. In a preferred embodiment, the standard information values include a release time, an impact time, and a return time of the printing wire, because these times may differ according to such variables as the characteristics of the print head, the eccentricity of the platen, and unevenness of adjustment of the gap. The impact printer can therefore adjust the gap using the standard information values, so as to take into account the wear of the parts of the printer due to repeated use.

BRIEF DESCRIPTION OF THE DRAWINGS

The above and other objects and features of the invention will be apparent to those skilled in the art from the following detailed description of the preferred embodiments, when considered in conjunction with the accompanying drawings, in which.

DETAILED DESCRIPTION OF THE PREFERRED EMBODIMENTS

Figure 1:
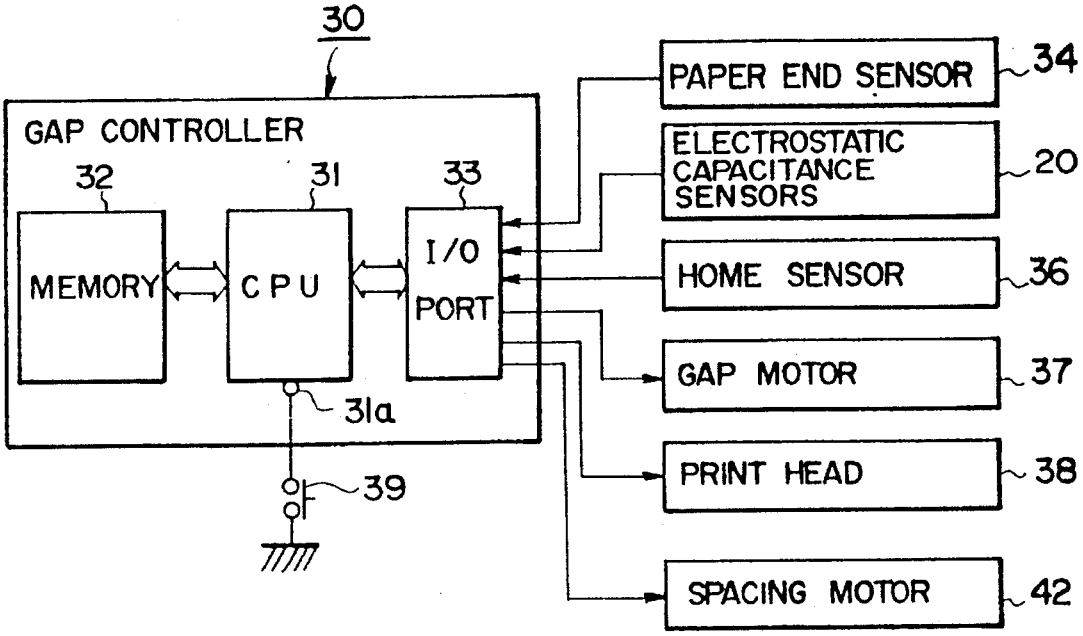
FIG. 1 is a block diagram illustrating a gap control system of an impact printer, according to a preferred embodiment of the invention.

Referring to FIG. 1 of the drawings, there is illustrated a gap control system of an impact printer according to a preferred embodiment of the invention. The gap control system includes a gap controller 30. The gap controller 30 includes a memory 32, a central processing unit (hereinafter called "CPU") 31, and an input/output port (hereinafter called "I/O port") 33. The gap controller 30 is connected to a paper end sensor 34, a home sensor 36, a gap motor 37, a print head 38 and a group of electrostatic capacitance sensors 20. The electrostatic capacitance sensors 20 are installed in the print head 38.

Figure 3:
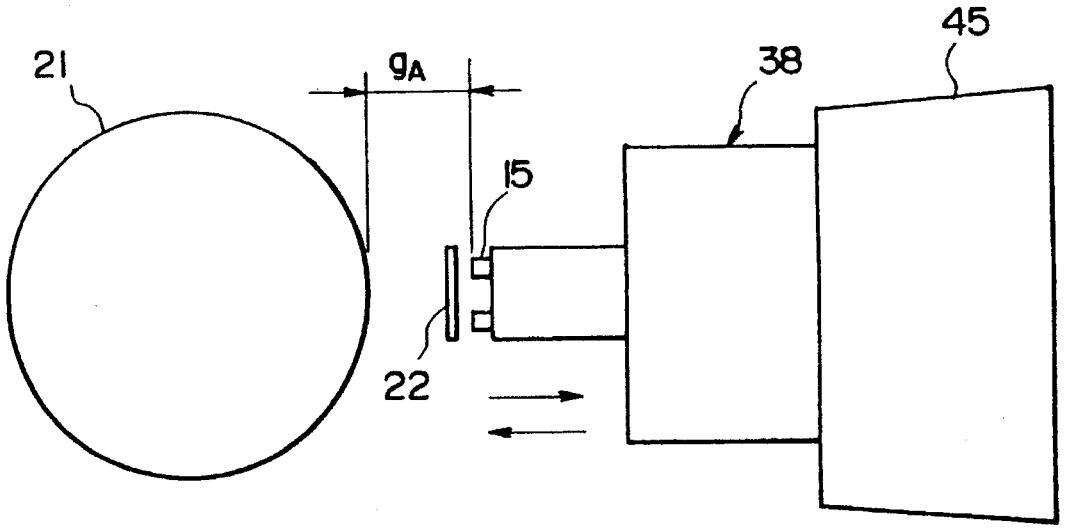
FIG. 3 is a schematic illustration of a gap between the print head and a platen of the impact printer of FIG. 1.

FIG. 3 is a schematic illustration of the print head 38, which attached to a carriage 45 in opposition to a platen 21. Printing wires 15 in the print head 38 are capable of projecting toward the platen 21 to strike an ink ribbon 22. Before printing occurs, the printing wires 15 are held stationary, spaced from the platen 21 by a standard gap gA.

Figure 2:
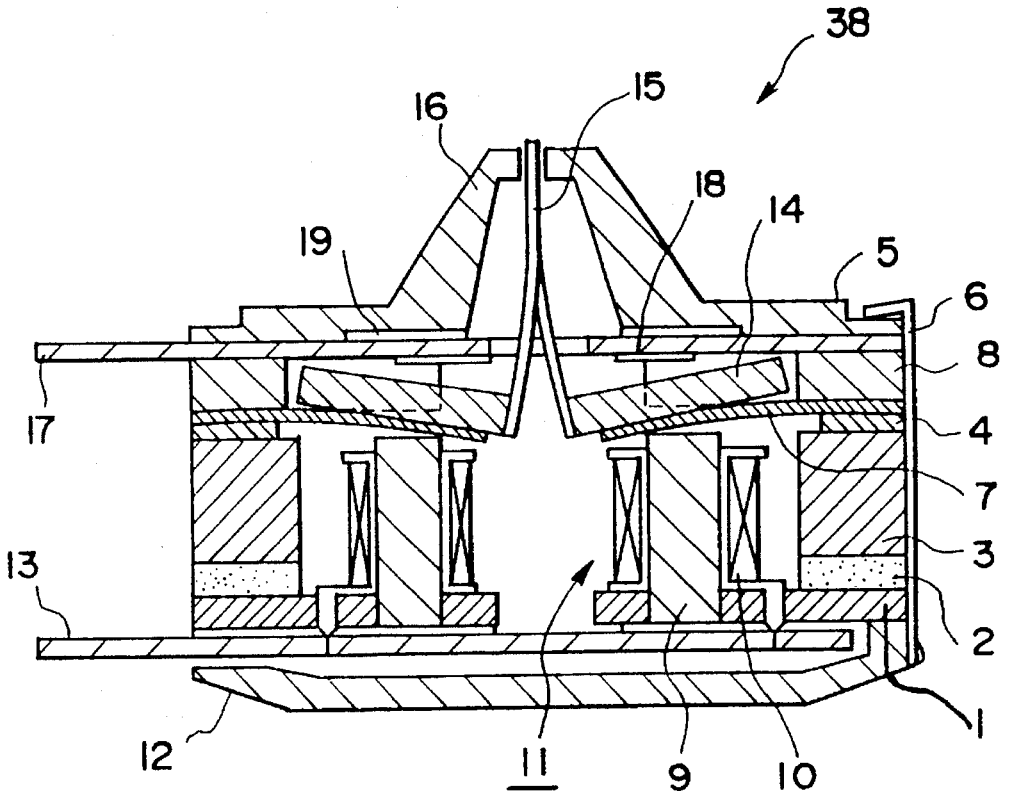
FIG. 2 is a cross-sectional view of a print head of the impact printer, according to a preferred embodiment of the invention.

Referring to FIG. 2, there is illustrated a print head 38 of known construction. In the print head 38, a permanent magnet 2, a base plate 3, and a spacer 4 are stacked sequentially on the periphery of a base 1. A plate spring 7 and a yoke 8 are clamped by a clamper 6 and held between the spacer 4 and a guide frame 5 so that the circumference of the plate spring 7 is fixed to the body of the print head 38. The plate spring 7 has a plurality of bendable portions extending radially inwardly from its circumference. The print head also includes a plurality of electromagnets 11. Each electromagnet 11 is composed of a core 9 that stands upright on the base 1, and a coil 10 wound on the core. A casing 12 is provided on a bottom side of the base and protects a power supply board 13 that supplies power to each electromagnet 11. A respective armature 14 is mounted on each of the bendable portions of the spring plate 7. The armatures 14 are placed adjacent to the yoke 8 and in opposition to the cores 9 of the respective electromagnets 11. Fixed to the tips of the respective armatures 14 are the printing wires 15. The printing wires 15 are guided through a wire guide 16 formed on the guide frame 5.

A circuit board 17 for detection is provided between the guide frame 5 and the yoke 8 and has mounted thereon a plurality of fixed electrode ends 18. The fixed electrode ends 18 oppose the armatures 14 with narrow spaces therebetween, so as to form, with detecting devices 19 on the board 17, the respective electrostatic capacitance sensors 20, for detecting electrostatic capacitances between the respective electrode ends 18 and armatures 14. The value of the electrostatic capacitance is determined in accordance with the space between the fixed electrode end 18 and the armature 14, and therefore, varies according to the shifts in position of the armature 14 during printing operations. Accordingly, each sensor 20 senses changes of the electrostatic capacitance value, thereby to detect movements of the printing wire 15 through the detecting device 19.

Between imprints, the plate spring 7 and armature 14 are held against the core 9 by the magnetic force of permanent magnet 2 which bends the plate spring 7 downwardly. During printing, the electromagnet 11 is excited to cancel the magnetic flux generated by the permanent magnet 2, thereby releasing the plate spring 7 and armature 14 from the core 9. Then, the printing wire 15 fixed to the armature 14 moves toward the platen 21 and strikes the ink ribbon 22 to cause ink to be imprinted on the printing medium.

Referring again to FIG. 1 by an end of the printing medium, the paper end sensor 34 detects the presence of the printing medium and outputs corresponding detection signals. The paper end sensor 34 outputs a paper end signal, for example, if there is no paper between the platen 21 and the print head 38. The home sensor 36 is arranged at a home position of the print head 38 and carriage 45, to detect whether the print head 38 is at the home position, located at one end of the platen. The gap motor 37 serves for adjusting the gap between the platen 21 and the print head 38 by moving back and forth the entire print head 38 as illustrated as arrows in FIG. 3.

Stored in the memory 32 are a control program, a standard impact time T0 (set at a time when the impact printer is assembled and adjusted), and a gap position for determining the rotation of the gap motor 17 corresponding to the gap at that time. A reset switch 39 is connected between a reset terminal 31*a* of the CPU 31 and ground.

Figure 4:
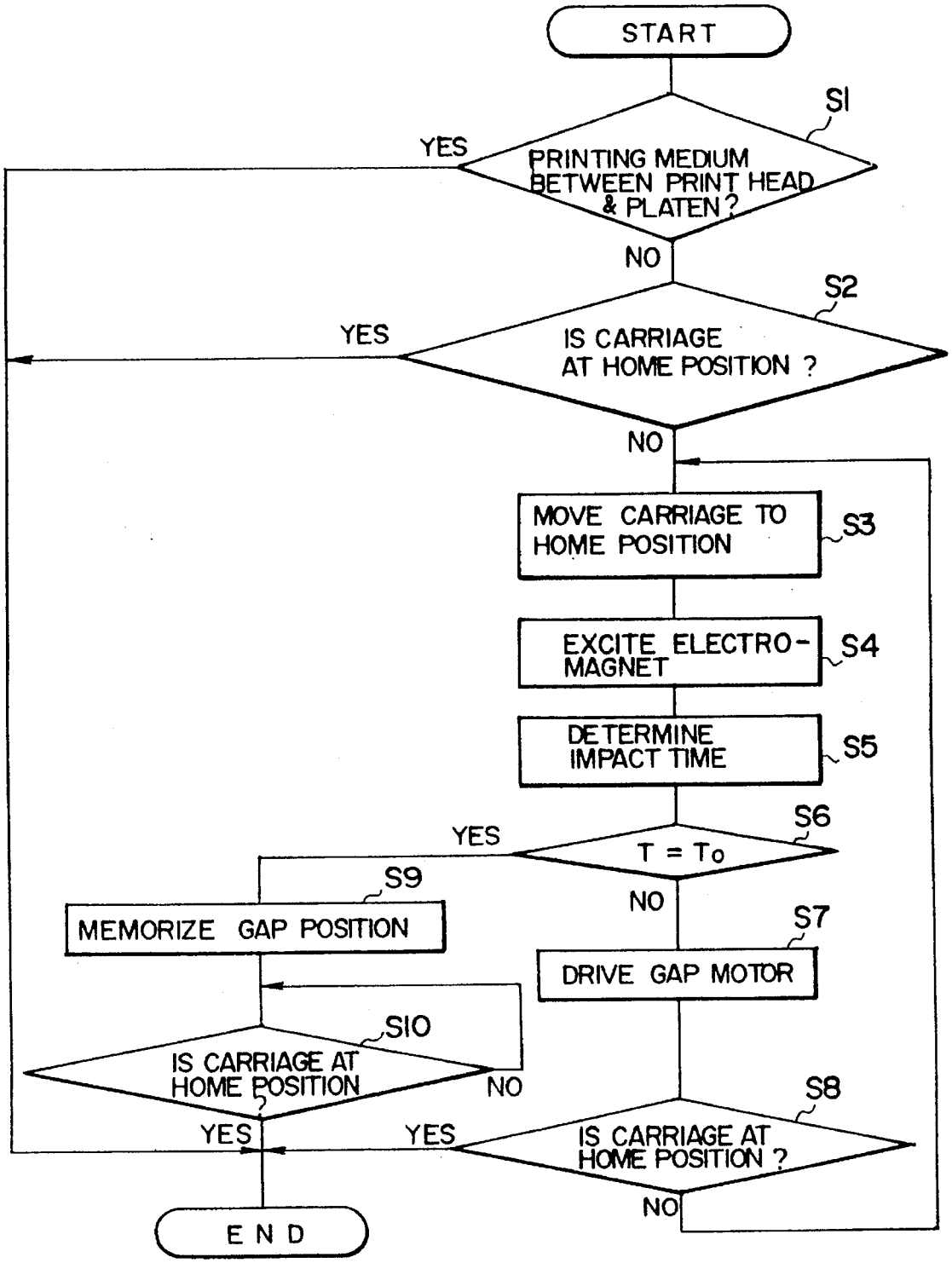
FIG. 4 is a flow chart of the operation of the gap control system of FIG. 1.

FIG. 4 is a flow chart illustrating the operations performed by the gap control system. Depressing the reset switch 39 grounds the reset terminal 31*a* of the CPU 31, thereby resetting a program counter not shown. The CPU 31 then accesses an address No. 0 of the memory 32, to start the control program.

At step S1, a judgment is made as to whether or not a printing medium is inserted in the printer between the platen and print head, based on a signal output by the paper end sensor 34. If the printing medium is detected, the process of the gap control program skips to the end. If the printing medium is not inserted, the process progresses to step S2.

At step S2, a judgment is made as to whether or not the carriage 45 that mounts the print head 38 is at the home position, based on a signal output by the home sensor 36. If the carriage is at the home position, the process of the gap control program skips to the end. If the carriage is not at the home position, the process progresses to step S3.

At step S3, the CPU 31 directs a spacing motor 42 (shown in FIG. 1) to move the carriage 45 toward the home position. Then, at step S4, the CPU 31 directs excitation of the electromagnet 11 in the print head 38 to counteract or cancel the magnetic flux of the permanent magnet 2, thereby to release the armature 14 from the core 9. At step S5, changes of the speed of the armature 14 are detected by the electrostatic capacitance sensor 20, and the CPU 31 determines the time duration or impact time T from the moment that the armature 14 is released up to a time that the print wire 15 strikes the platen 21. At step S6, the CPU 31 reads out an impact time T0 measured and stored as a standard information value, at a time that the impact printer was assembled and adjusted. The CPU 31 compares this impact time T0 with the just detected impact time T. If the two times are equal to each other, the process proceeds to step S9. If they are not equal to each other, the process proceeds to step S7.

At step S7, the CPU 31 directs the gap motor 37 to adjust the gap g between the print head 38 and the platen 21, by an incremental amount. At step S8, a judgment is made as to whether or not the carriage is at the home position, based on a signal detected by the home sensor 36. If the carriage 45 is at the home position, the process of gap control skips to the end. If the carriage is not at the home position, the process returns to step S3.

At step S9, the CPU 31 controls the memory 32 to store data indicative of the position of the gap motor 37 which corresponds to the actual gap g just measured at that time. Then, at step S10, the CPU 31 directs the spacing motor 42 to move the carriage to the home position and waits for the home sensor 36 to detect that the carriage has reached the home position. Upon such detection, the gap control process is complete.

As described above, the impact time T may be measured multiple times depending on the initial position of the carriage 45.

Figure 5:
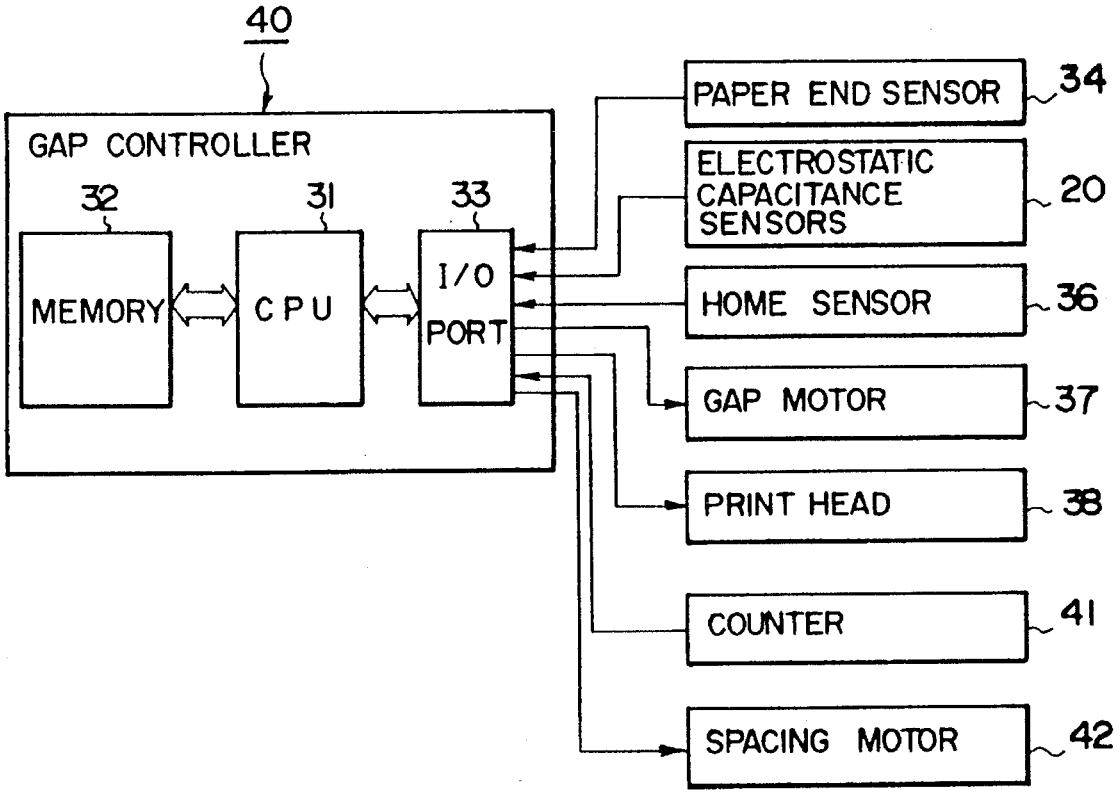
FIG. 5 is a block diagram of a gap control system of an impact printer according to another preferred embodiment of the invention.

Referring to FIG. 5, another preferred embodiment is shown. The gap controller 40 includes a CPU 31, a memory 32, and an I/O port 33, as in the embodiment described above. The gap controller 40 is connected to a paper end sensor 34, a plurality of electrostatic capacitance sensors 20, a home sensor 36, a gap motor 37, a print head 38, and a counter 41. That is, the major difference from the embodiment described above is that the counter 41 is provided for determining when to adjust the gap between the platen 21 and the printing head 38. The counter 41 counts the number of dot printing occurrences and outputs an interrupt signal to the gap controller 40 every predetermined number of such occurrences. The CPU 31 conducts the adjustment of the gap as described above at a time that the CPU 31 receives the interrupt signal.

It is to be noted that, in the embodiments described above, the adjustments of the gap can be performed without of the printing. In other words, the adjustments can be performed while no paper exist between the platen 21 and the print head 38. The electromagnet 11 is excited at that time to conduct the gap adjustment described above. According to this control, the gap is adjusted again notwithstanding the position of the printing head 38. Moreover, detection of the impact time T during rotation of the platen 21 improves the accuracy of the gap adjustment, since information regarding the eccentricity of the platen 21 is obtained from the detection.

In a modification of the embodiments described above, the memory 32 stores data of impact time T corresponding to a predetermined gap g, and a gap adjusting mode selector and an alarm device are provided for conducting operations in an "Automatic Mode" and a "Non-Automatic Mode". If "Automatic Mode" is selected by the gap adjusting mode selector, the gap is automatically adjusted either at a time of resetting the CPU 31 when the power supply source is turned on or every predetermined number of printing occurrences (impacts of the printing wires). If the "Non-Automatic Mode" is selected, the gap is not adjusted automatically, and when the gap g reaches a predetermined value, the alarm device issue an alarm to the operator by a display on a display device (not shown). The user can adjust the gap through manual controls, the menu of the printer, or through instructions from a host computer.

As described above, the impact printer thus described detects the impact time T, i.e. the duration of time up to a time that the printing wire 15 strikes the platen 21, and compares it with the impact time T0 determined at the time that the impact printer is assembled and adjusted. According to an embodiment of the invention, the impact printer also can calculate a variety of time information by slicing the output of the electrostatic capacitance sensors 20. Such calculated information may be compared to information previously calculated and stored and the result of the comparison can be used to adjust the gap.

In the forgoing embodiments, the gap adjustment has been performed by comparing the just measured gap information with the standard information value stored in the memory. The standard information value itself has not been changed or renewed prior to the adjustment being performed.

Figure 6:
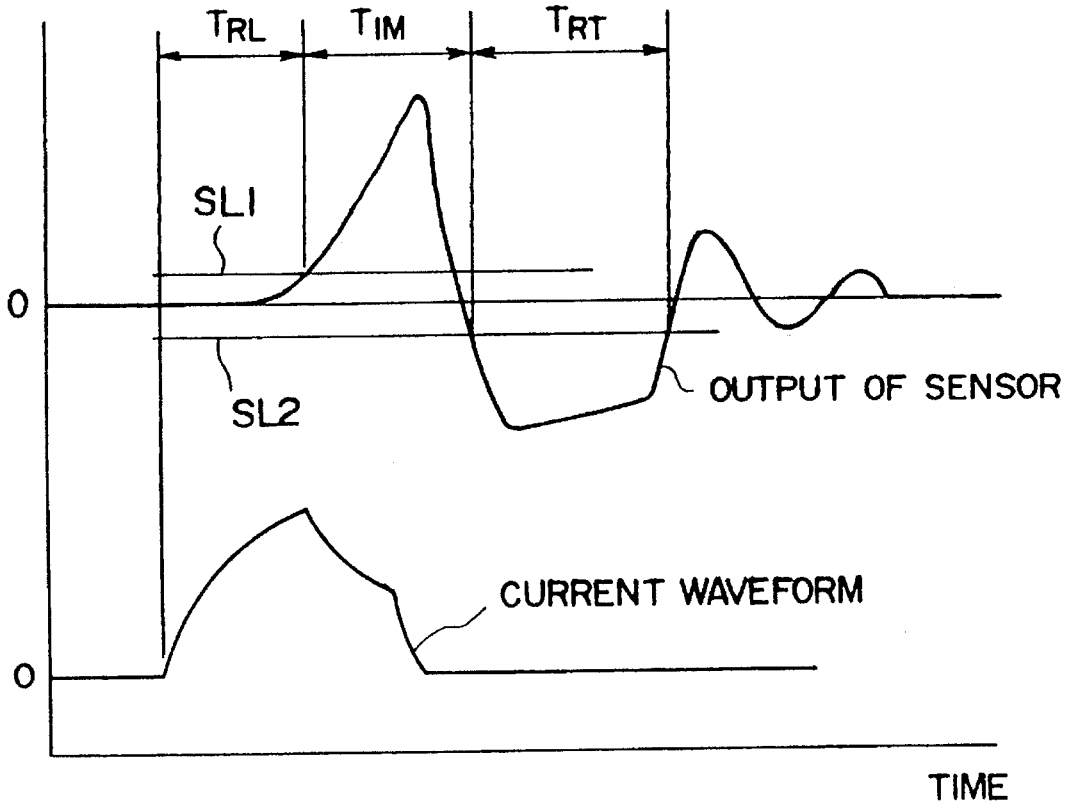
FIG. 6 is a timing diagram of a speed waveform showing standard information values for an impact printer according to yet another preferred embodiment of the invention.

FIG. 6 shows an output of the electrostatic capacitance sensor of the invention as a function of time and time information in the form of a speed waveform. Time information of three types is determined, under the control of the CPU 31 by slicing the output of the electrostatic capacitance sensor at a high slice level SL1 and at a low slice level SL2.: Namely, a release time $T_{RL}$ which is a duration time from the beginning of the current waveform until the core 9 releases the armature 14, an impact time $T_{IM}$ from the end of the release time up to a time that the printing wire 15 strikes the printing medium, and a return time $T_{RT}$ from the end of the impact time up to a time that the core 9 captures the armature 14 again after impact, are obtained. The high slice level SL1 and the low slice level SL2 are used for reducing the noise at a time that the time information is detected. Release time $T_{RL}$, impact time $T_{IM}$, and return time $T_{RT}$ of respective printing wires are detected and stored in the memory 32 as the standard information value, at the time when the printer is assembled. Then, the impact printer can change or renew those values based on the data subsequently obtained.

Figure 7:
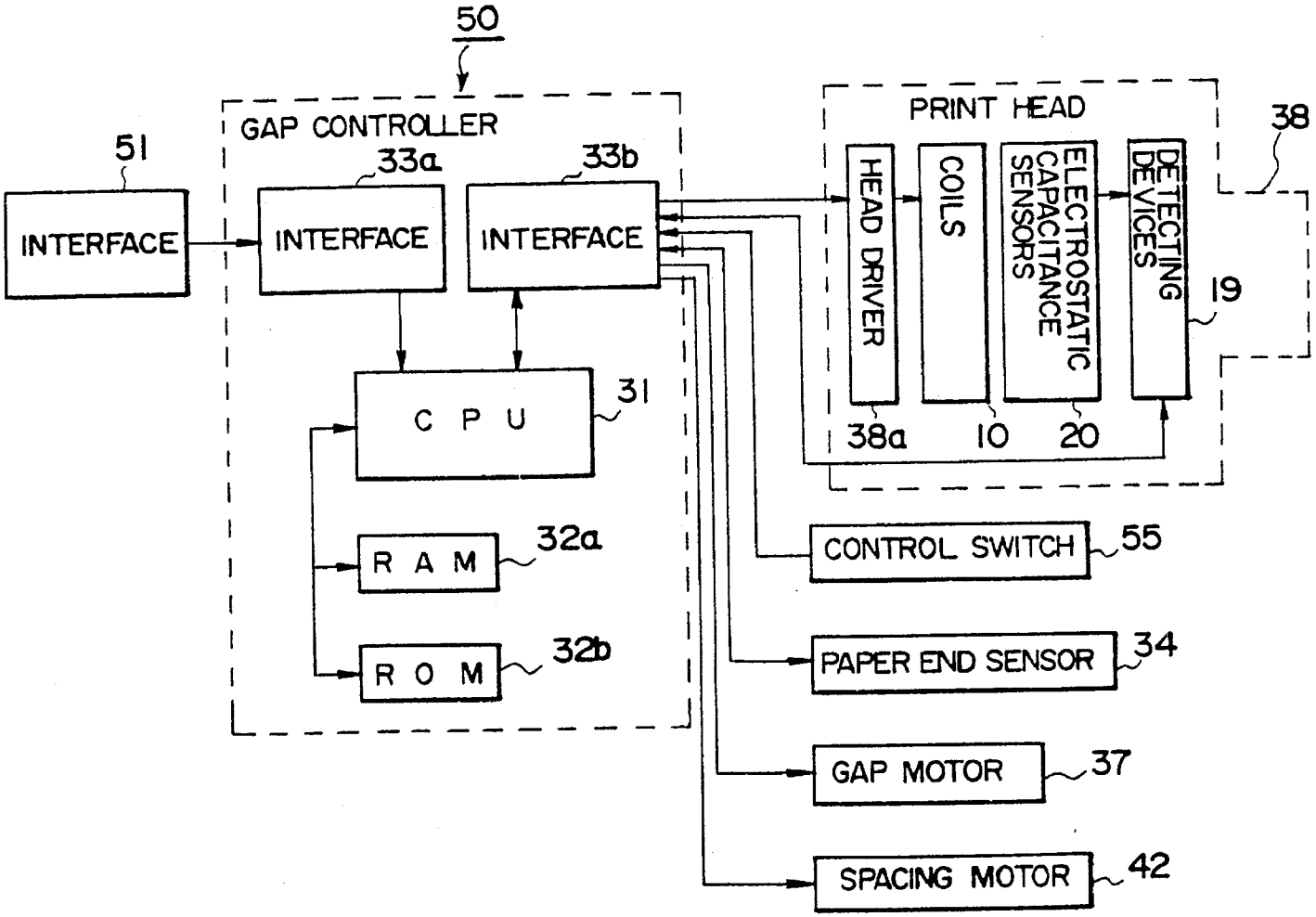
FIG. 7 is a block diagram of a gap control system of an impact printer according to another preferred embodiment of the invention.

Now, referring to FIG. 7, another preferred embodiment of an impact printer is shown. In FIG. 7, the same reference numerals designate the same elements as those of the embodiment described above with reference to FIG. 1. In this embodiment, the standard information value itself stored in advance in the RAM 32*a*, with which the actually obtained data is compared, is changed or renewed to reflect changes of the parts of the printer. The print head 38 includes a head driver 38*a* operating in response to a signal from a CPU 31 in a gap controller 50, a plurality of coils 10 of the electromagnets for operation of the armatures 14, a plurality of electrostatic capacitance sensors 20 for detecting the movement of the respective armatures 14, and a plurality of detecting devices 19 for outputting a detection signal to the gap controller 50. The gap controller 50 is connected to a paper end sensor 34 for detecting existence of a printing medium between the platen and the print head 38, and a gap motor 37 is provided for moving the printer head 38 toward or away from the platen 21. The gap controller 50 is also connected to a host computer, not shown, to receive data for printing, through an interface circuit 51. The CPU 31 in the gap controller 50 is used for performing processing of various types, such as, calculating the gap g based on the data of release time $T_{RL}$, impact time $T_{IM}$, and return time $T_{RT}$. The CPU 31 is connected to the host computer and other devices, through interfaces 33*a*, 33*b*. Connected to the CPU 32 in the gap controller 50 also are a RAM 32*a* as a backup memory for storing printing data, the standard information values of release time $T_{RL}$, impact time $T_{IM}$, and return time $T_{RT}$ for each printing wire 15, and the like, and a ROM 32*b* for storing the control program and fonts for printing. The CPU 31, RAM 32*a* and ROM 32*b* also serve other functions related to printing operations.

At the time that the impact printer is constructed, the data of release time $T_{RL}$, impact time $T_{IM}$, and return time $T_{RT}$ for each printing wire 15 are detected under predetermined conditions, such as with a gap g in a preset range and a known type of printing paper. Differences in the detected values of release time $T_{RL}$, impact time $T_{IM}$, and return time $T_{RT}$ will occur according to the nature of the print head 38, the eccentricity of the platen 21, nonuniformity of adjustment of the gap, and the like. Those values initially are stored in the RAM 32*a* as "standard information values". In other words, the RAM 32*a* initially stores standard information values which take into account the nonuniformity of characteristics of the printer at the time the printer is assembled.

The stored standard information values can be replaced by new information values, that is "renewed", in accordance with changes of the gap g. Each time the standard information values are to be renewed, the temperature and drive voltage of the print head 38 are detected, and the new standard information values are corrected to correspond to values at a normal temperature and a reference voltage. Such a correction is performed, for example, at a time that the ink ribbon 22 is set or that the power is turned on, prior to loading the printing medium. In addition, the standard information values can also be replaced at a time that the printer receives a particular function command from a host computer not shown. The standard information values and new information values may be outputted from the impact printer by depressing a special key or keys of a front panel (not shown) of the impact printer. Therefore, it is possible to store the standard information values at a time of shipping from a factory, and it is also possible to check the condition of the impact printer by measuring new information values at times that routine maintenance and customer service are performed, and to update the standard information values upon replacement of the print head 38.

By setting a permissible range for the new information values, it becomes possible, for example, to detect defects in the print head such as folded wires, folded springs, and the like, and to detect extraordinary gaps g, when the detected values g are outside of the range. A display of an alarm at a control panel or the like (not shown), can indicate that it is time to replace the print head 38 and check the gap g since a check of the gap g and renewal of standard information values is performed in a time when the printing paper is fed to the printer. It is less frequently required in a case when the impact printer feeds the printing paper from a rear or bottom side of the printer, using roll paper, since the roll provides an extended source of paper of the same type. By comparison, the renewal of the standard information values is more frequently required if the impact printer feeds single sheets of printing paper from a top side. It is therefore desirable to control the frequency of the renewal, according to the routes of the printing medium, by disposing counters at appropriate locations inside of the impact printer.

Referring again to the illustration of the print head 38 in FIG. 2, wear of the core 9 due to its contact with armature 14 ordinarily is suppressed by coating the core 9 with oil. If the oil deteriorates so that its viscosity becomes high, the armature 14 may stick to the core 9 during a long time interval between use. As a result, inaccurate information values may be detected at a time of reuse, and also such incorrect values may be stored at a time of renewing the standard information values. Furthermore, malfunctions may occur during test conducted before actual printing. To avoid such problems, the impact printer can be caused to perform dummy impacts by initiating a small current flow initiated through the respective coils 10 for the printing wires 15, immediately before the renewal of the standard information values or the test printing.

Operation of the impact printer of FIG. 7 will now be described with reference also to the flow charts of FIGS. 8 and 9.

Figure 8:
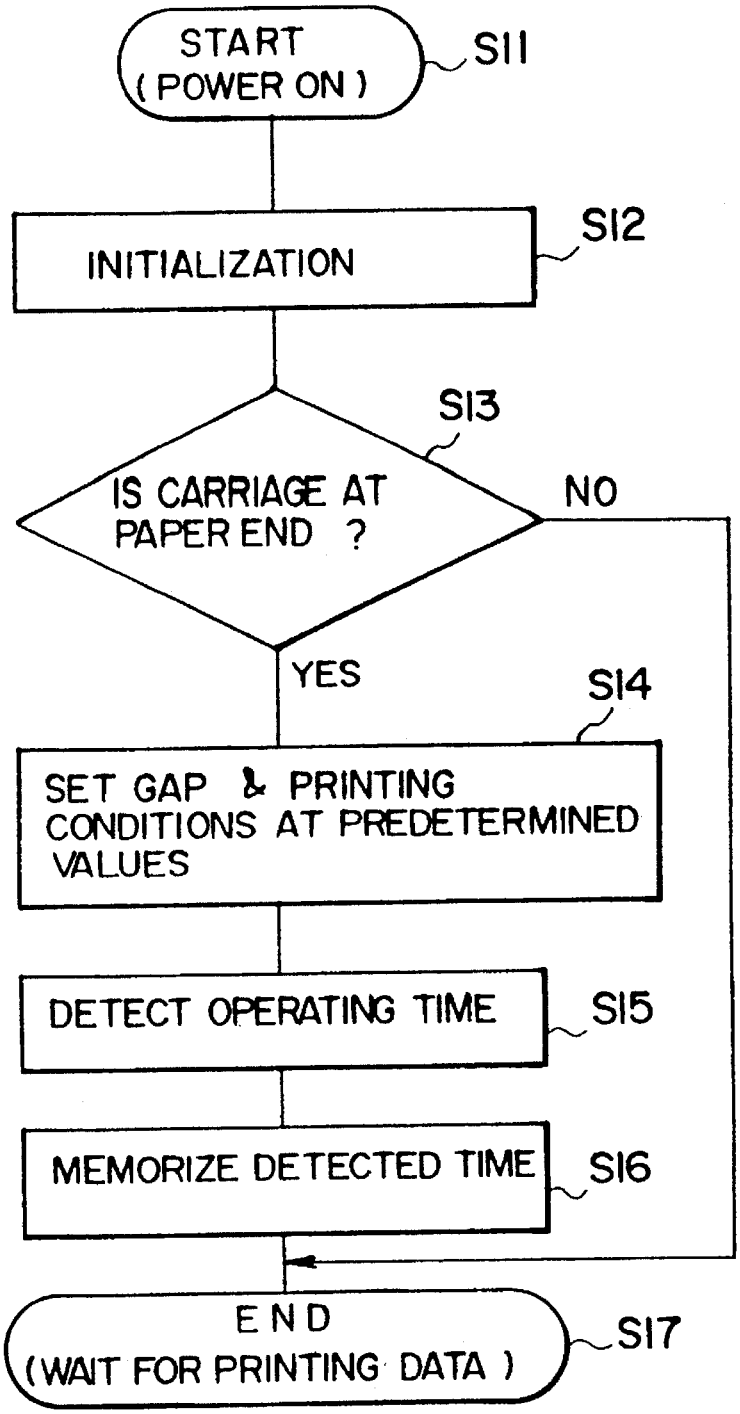
FIG. 8 is a partial flow chart of the operation of the gap control system of FIG. 7.
Figure 9:
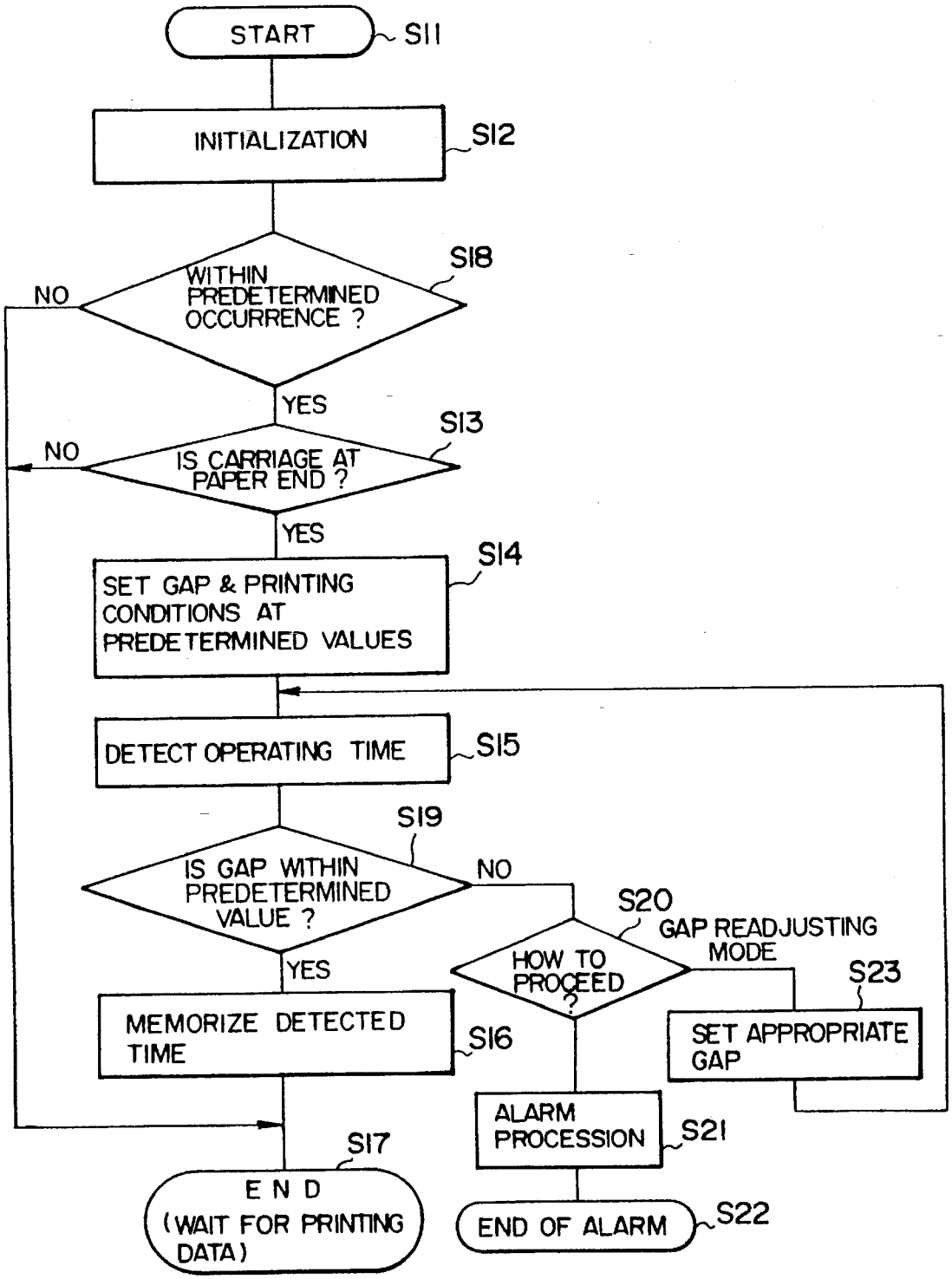
FIG. 9 is another partial flow chart of the operation of the gap control system of FIG. 7.

Referring to FIG. 8, after startup, the power of the impact printer is turned on at step S11 and initialization of the CPU 31 is performed at step S12 in a conventional manner. A judgment is made at step 13 as to whether or not a printing medium is inserted in the printer between the platen 21 and print head 38, based on a signal output by the paper end sensor 34. If the printing medium is detected, the process for renewing the standard information values skips to the end and the printer turns to an actual operating mode awaiting printing data, at step S17. If the printing medium has not been inserted, the process progresses to step S14.

At step S14, the CPU 31 directs excitation of the electromagnet 11 in the print head 38 to measure the standard information values, under the same conditions as those set for printing. At step S15, the gap motor 37 drives the print head 38 to a position spaced from the platen 21 by a predetermined gap g. Also at step S15, each printing wire 15 in sequence is caused to directly strike the platen 21, and the actual release time $T_{RL}$, impact time $T_{IM}$, and return time $T_{RT}$ are detected for each printing wire 15. At step S16, the detected values are stored in the RAM 32*a* as the standard information values. At the same time, the old time data are deleted from the RAM 32*a*. At step S16, the standard information values previously stored in the RAM 32*a* are replaced by new information values, based on the gap g.

The above mentioned operations are performed with the ink ribbon being installed. If necessary, a sensor, for detecting whether the ribbon is properly installed or not, can be provided. Between step S15 and step S16, some supplemental proceedings, such as temperature compensation and an abnormal value check, can be performed. At step S16, one or more, but not all than one of the detected values can be stored in the RAM 32*a*. Or, other information values calculated in accordance with the detected values can be also used instead of the detected values themselves.

According to the embodiment described above, the standard information values already set and stored in the memory and used to determine the optimum gap can be renewed automatically at the paper end position without any additional or special manipulation by an operator when the power is turned on so that an accurate gap adjustment can be performed based on accurate knowledge of the paper thickness and driving conditions of the print head 38.

Another operation of the impact printer of FIG. 7 will be described with reference to the flow chart of FIG. 9. In this operation, steps S18 and S19 are added in the process of the standard information value renewal program illustrated as steps S11 to S17 in FIG. 8.

Other steps S20 to S23 are also added to further proceed the gap adjustment based upon the renewed standard information values stored in the RAM 32*a* at step S16. The standard information value renewal program is not so frequently performed when a roll of paper is used because the paper is normally already set when the power happens to be turned on, whereas it is so frequently performed when a sheet of paper is used. If the renewal program is performed so frequently whenever the power turns on in case of a sheet of paper, much ink is deposited on the platen 21.

To avoid the above phenomenon, a judgment is made at step S18 as to whether or not some occurrences have exceeded a predetermined number. How many times has a power supply switch turned on; how long has the printer been used; and how many letters have been printed are considered to be a kind of occurrences.

Accordingly at step S18, such occurrences are checked as to whether such occurrences fall within the predetermined number. If the occurrence falls within the predetermined number, the process of the renewal program progresses to step S13. If the occurrences exceeds the predetermined number, the process skips to the end.

At step S19, the CPU 31 reads out from the RAM 32*a* data representing the standard information values measured and stored at a time the printer was assembled and later repeatedly renewed. The CPU 31 compares this standard information values with the just-detected data of release time $T_{RL}$, impact time $T_{IM}$, and return time $T_{RT}$.

If the difference of two data falls within a predetermined value, then the process progresses to step S16, otherwise to step S20. Judgment is made at step S20 how to proceed. If an "Alarm Procession Mode" is selected, the process progresses to step S21 where the alarm device alarms to the operator by a display on a display device (not shown).

The operator can adjust the gap through manual controls, the menu of the printer, or through instructions by a host computer. Then, the process progresses to the end step S22 If a "Gap Readjusting Mode" is selected, the process progresses to step S23 where the CPU 31 directs the gap motor 37 to adjust the gap g between the print head 38 and the platen 21, by a decremental amount. Then, the process proceeds to step S15. The selection at step S20 can be made either automatically or manually.

It is to be noted that, although in the embodiments described above the impact printer uses a spring-charge type print head, other types of print heads, for example, the so called clapper-type print head, can be used for the impact printer.

It is understood that although the present invention has been described in detail with respect to preferred embodiments thereof, persons skilled in the art will recognize various other embodiments and variations that fall within the scope and spirit of the invention, which is limited only by the appended claims.

What is claimed is:

1. An impact printer having a print head, said print head having an armature, a printing wire fixed to said armature for movement therewith toward a platen, said platen disposed in opposition to said print head, and a sensor for detecting movement of said armature, said print head being movable lengthwise of said platen with respect to a home position at one end of said platen, said impact printer comprising:

(a) monitoring means for monitoring a position of said armature, based on an output of said sensor while said armature is moving;

(b) home sensor means for detecting whether or not said print head is at said home position;

(c) a paper detector for detecting existence of a printing medium in said printer between said platen and said print head;

(d) gap motor means, responsive to a drive signal, for adjusting a gap between said printing wire and said platen; and (e) gap control means, responsive to detection signals output by said home sensor and said paper detector, for controlling said print head to swing said armature so as to cause a tip of said printing wire to strike said platen while said print head is outside of an area for printing, determining a time of impact of said tip with said platen based on a position of said armature as monitored by said monitoring means, performing a comparison of the time of impact with a predetermined impact time, and generating the drive signal according to a result of the comparison and applying the drive signal to said gap motor means to adjust the gap according to the result.

2. An impact printer according to claim 1, wherein said printing head includes a plurality of printing wires, a plurality of armatures corresponding to said printing wires, and a plurality of electrostatic sensors corresponding to said armatures.

3. An impact printer according to claim 1, further comprising a counter for counting a number of times that said armature is swung, and means, responsive to a predetermined count by said counting means, for outputting an interrupt signal to actuate said gap control means to adjust the gap.

4. An impact printer as set forth in claim 1, wherein the printing medium is a roll of paper.

5. An impact printer as set forth in claim 1, wherein the gap is adjusted while said platen is rotated.

6. An impact printer as set forth in claim 1, further comprising:

alarm display means for displaying an alarm;

mode selecting means for selecting either an automatic mode or a non-automatic mode as a mode for adjusting the gap, and outputting a signal indicative of the selected mode; and memory means for storing data of an impact time corresponding to a predetermined gap, wherein said gap control means controls adjustment of the gap when a signal from said mode selecting means indicates selection of the automatic mode, and, when the signal from said mode selecting means indicates selection of the non-automatic mode, said gap control means activating said alarm display means if the gap is detected to be equal to the predetermined gap based on data stored in said memory means.

7. An impact printer as set forth in claim 1, wherein said sensor is an electrostatic capacitance sensor formed from said armature and a part fixed in opposition to said armature such that when said armature moves with respect to said platen said armature moves with respect to said part.

8. An impact printer having a print head movable with respect to a home position, said print head having an armature, a printing wire fixed to said armature for reciprocal movement therewith toward and away from a platen, said platen disposed in opposition to said print head, and a sensor for detecting movement of said armature, said impact printer comprising:

(a) monitoring means for monitoring a position of said printing wire, based on an output of said sensor while said printing wire is moved relative to said platen, said monitoring means including speed waveform determining means for determining a speed waveform indicative of a speed of said printing wire while said printing wire is moved relative to said platen under predetermined conditions;

(b) detecting means for detecting an operation time of said printing wire during which said printing wire is moved with respect to said platen, based on the determined speed waveform;

(c) a memory storing in advance a standard information value, the standard information value representing a standard operation time of said printing wire;

(d) means for renewing the standard information value based on the operation time detected by said detecting means, and replacing the standard information value stored in advance in said memory by the renewed standard information value; and (e) means for adjusting a gap between said printing wire and said platen based on the stored renewed standard information value and an operation time detected by said detecting means.

9. An impact printer as set forth in claim 5, wherein the standard information value comprises a plurality of standard information values, including a release time, an impact time, and a return time of said printing wire.

10. An impact printer as set forth in claim 8, wherein said sensor is an electrostatic capacitance sensor formed from said armature and a part fixed in opposition to said armature, said armature being movable with respect to said part, said monitoring means monitoring a position of said printing wire based on an output of said electrostatic capacitance sensor while said printing wire and said armature therewith are moved relative to said fixed part, said detecting means detecting the operation time of said printing wire while said printing wire is moved with respect to said fixed part.

11. An impact printer according to claim 8, wherein said print head is movable lengthwise of said platen with respect to a home position at one end of said platen, further comprising:

home sensor means for detecting whether said print head is at said home position; and a paper detector for detecting existence of a printing medium in said printer between said platen and said print head;

said means for adjusting the gap including gap motor means, response to a drive signal, for moving the print head to adjust the gap and gap control means, responsive to detection signals output by said home sensor and said paper detector, for controlling said print head to swing said armature so as to cause a tip of said printing wire to strike said platen, determining a time of impact of said tip with said platen based on a position of said armature as monitored by said monitoring means, performing a comparison of the time of impact with a predetermined impact time, and generating the drive signal according to a result of the comparison and applying the drive signal to said gap motor means to adjust the gap according to the result.

12. An impact printer according to claim 11, further comprising a counting means for counting a number of times that said armature is swung, and means, responsive to a predetermined count by said counting means, for outputting an interrupt signal to actuate said gap control means to adjust the gap.

13. An impact printer according to claim 11, wherein said gap control means is responsive to the detection signals output by said home sensor means and said paper detector, to control said print head to swing said armature so as to cause said tip of said printing wire to strike said platen while said print head is outside of an area for printing.

14. An impact printer as set forth in claim 11, further comprising:

alarm display means for displaying an alarm;

mode selecting means for selecting either an automatic mode or a non-automatic mode as a mode for adjusting the gap, and outputting a signal indicative of the selected mode; and memory means for storing data of an impact time corresponding to a predetermined gap, wherein said gap control means controls adjustment of the gap when a signal from said mode selecting means indicates selection of the automatic mode, and, when the signal from said mode selecting means indicates selection of the non-automatic mode, said gap control means activating said alarm display means if the gap is detected to be equal to the predetermined gap based on the data stored in said memory means.

15. A method for driving an impact printer having a print head, the print head having an armature, a printing wire fixed to said armature for movement therewith toward a platen, the platen disposed in opposition to the print head, and a sensor for detecting movement of the armature, the print head being movable lengthwise of the platen with respect to a home position at one end of the platen, said method comprising steps of:

(a) detecting with a home sensor whether the print head is at the home position;

(b) detecting with a paper sensor the existence of a printing medium in the printer between the platen and the print head; and (c) adjusting a gap between the printing wire and the platen, in response to detection signals respectively output by said home sensor and said paper end sensor when the detection signal output by the home sensor means indicates that the print head is not at the home position and the detection signal output by the paper detector indicates an absence of paper between the print head and the platen, including controlling the print head to swing the armature so as to cause a tip of the printing wire to strike the platen;

determining a time of impact of the tip with the platen, based on a position of the armature, performing a comparison of the time of impact with a predetermined impact time, and outputting a drive signal for adjusting the gap according to a result of the comparison.

16. A method according to claim 15, further comprising the steps of counting a number of times that the print wire and armature are moved toward the platen, and initiating step c when a count reached during said step of counting reaches a predetermined number.

17. A method for driving an impact printer having a print head movable with respect to a home position, the print head having an armature, a printing wire fixed to the armature for reciprocal movement therewith toward and away from a platen, the platen disposed in opposition to the print head, and a sensor for detecting movement of the armature, the method comprising steps of:

(a) monitoring a position of the printing wire based on an output of the sensor while the printing wire is moved relative to the platen;

(b) determining a speed waveform indicative of a speed of the printing wire while the printing wire is moved under predetermined conditions;

(c) detecting an operation time of the printing wire during which the printing wire is moved with respect the platen based on the determined speed waveform;

(d) storing a standard information value prior to said step a, the standard information value representing a standard operation time of the printing wire;

(e) adjusting a gap between the printing wire and the platen disposed in opposition to the print head, based on the operation time detected by said detecting means and the stored standard information value stored in said step d;

(f) renewing the standard information value, based on the operation time detected in said step c;

(g) storing the renewed standard information value obtained in said step f in place of the standard information value stored in said step d; and (h) adjusting the gap between the printing wire and the platen disposed in opposition to the print head, according to the renewed standard information value stored in said step g.

18. A method according to claim 17, wherein the print head is movable lengthwise of the platen with respect to a home position at one end of the platen, and said step e includes the steps of:

(i) detecting whether the print head is at the home position;

(ii) detecting an absence of a printing medium in the printer between the platen and the print head; and (iii) adjusting the gap when the print head is detected away from the home position in said step i and an absence of the printing medium is detected in said step ii.

19. A method according to claim 18, wherein said step iii of adjusting the gap includes the steps of controlling the print head to swing the armature so as to cause a tip of the printing wire to strike the platen;

determining a time of impact of the tip with the platen based on a position of the armature, performing a comparison of the time of impact with a predetermined impact time, and generating a drive signal according to a result of the comparison and applying the drive signal to a gap motor, the gap motor moving the print head to adjust the gap.

20. An impact printer having a print head, said print head having an armature, a printing wire fixed to said armature for movement therewith toward a platen, said platen disposed in opposition to said print head, and a sensor for detecting movement of said armature, said print head being movable lengthwise of said platen with respect to a home position at one end of said platen, said impact printer comprising:

(a) monitoring means for monitoring a position of said armature, based on an output of said sensor while said armature is moving;

(b) home sensor means for detecting whether or not said print head is at said home position;

(c) a paper detector for detecting existence of a printing medium in said printer between said platen and said print head;

(d) gap motor means, responsive to a drive signal, for adjusting a gap between said printing wire and said platen; and (e) gap control means, responsive to a detection signal output by said home sensor and a detection signal output by said paper detector, for controlling said print head to swing said armature so as to cause a tip of said printing wire to strike said platen, determining a time of impact of said tip with said platen based on a position of said armature as monitored by said monitoring means, performing a comparison of the time of impact with a predetermined impact time, and generating the drive signal according to a result of the comparison and applying the drive signal to said gap motor means to adjust the gap according to the result;

wherein the detection signal output by said home sensor means indicates that said print head is not at the home position and the detection signal output by said paper detector indicates an absence of paper between said print head and the platen.

* * * * *